US008052488B2

(12) United States Patent
Ohki

(10) Patent No.: US 8,052,488 B2
(45) Date of Patent: Nov. 8, 2011

(54) CABLE CONNECTOR

(75) Inventor: Yasuo Ohki, Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 12/953,643

(22) Filed: Nov. 24, 2010

(65) Prior Publication Data

US 2011/0183550 A1 Jul. 28, 2011

(30) Foreign Application Priority Data

Jan. 26, 2010 (JP) ..... 2010-014063

(51) Int. Cl.
*H01R 13/405* (2006.01)

(52) U.S. Cl. ..... 439/736; 439/948; 439/752

(58) Field of Classification Search ..... 439/736, 439/271, 948, 606, 936, 752
See application file for complete search history.

(56) References Cited

U.S. PATENT DOCUMENTS 4,778,404 A * 10/1988 Pass ..... 439/387
5,795,170 A * 8/1998 Okabe ..... 439/252
7,621,786 B2 * 11/2009 Yavari et al. ..... 439/752.5

FOREIGN PATENT DOCUMENTS

JP 62-57390 4/1987

* cited by examiner

*Primary Examiner* — Javaid Nasri
(74) *Attorney, Agent, or Firm* — Wenderoth, Lind & Ponack, L.L.P.

(57) ABSTRACT

To prevent an inflow of resin at the time of integral molding and prevent the outer shape from upsizing, there is provided a cable connector including a connector body formed of an insulating material and formed with a plurality of terminal through holes; connecting terminals fitted into the terminal through holes; a cable including a plurality of leads having end portions that are crimped to base portions of the connecting terminals respectively; and a synthetic resin bushing configured to couple the connector body, a tip end portion of the cable including the leads exposed and diverged therefrom integrally by molding. Stoppers are disposed between end portions of the leads and the connecting terminals and inside the connector body and prevent intrusion of synthetic resin as the bushing material so as not to flow from ends of the leads toward ends of the connecting terminals when coupling by molding.

3 Claims, 10 Drawing Sheets

CABLE CONNECTOR

BACKGROUND OF THE INVENTION

1. Field of the Invention

The present invention relates to a cable connector and, more specifically, to a cable connector of structure which prevents inflow of molding resin when integrally molding a cable connected to a terminal with a bushing in order to enhance a tensile strength of a cable and to secure fluid-tight properties.

2. Prior Art

In the prior art, as disclosed in JP-UM-A-62-57390, a cable connector including a bushing passed through and mounted to a pass-through slot of an equipment member in a fluid-tight manner, and a waterproof connector connected to the pass-through bushing and having a terminal connected to a conductor of a cable is known. The fluid-tight properties (waterproof properties) of the cable connector configured in this manner can hardly be secured and maintained due to its age deterioration, for example. Therefore, as shown in FIGS. 9A to 10C, a cable connector 20 is coupled by integrally molding an outer insulating matrix 21 and an inner insulator 21*a* with a tip end portion of a cable 26 including a plurality of leads 22 exposed and diverged therefrom using a bushing 25 formed of synthetic resin.

In other words, as shown in FIGS. 9A and 9B, the cable connector 20 includes the outer insulating matrix 21 and the inner insulator 21*a*, and the inner insulator 21*a* is formed with a plurality of assembly holes 21*b* for terminals which are formed into a grid shape and pass through in the fore-and-aft (fitting) direction. Metallic connecting terminals 23 connected to the respective ends of the leads 22 by crimped portions 23*b* are fitted into the assembly holes 21*b*. The connecting terminals 23 connected to the leads 22 are press-fitted into the inner insulator 21*a*. Then, the inner insulator 21*a* is covered with the insulating matrix 21, and is accommodated in a metal mold. Subsequently, the outer insulating matrix 21, the leads 22, the tip end portion of the cable 26 including a plurality of leads 22 exposed and diverged therefrom and the bushing 25 which envelopes the outer insulating matrix 21, the leads 22, and the tip end portion of the cable 26, are integrally molded. Reference numeral 25*a* designates a mounting hole, and reference numeral 26*a* designates an outer sheath of the cable 26, respectively.

However, in the case of the cable connector 20 as described above, as shown in FIG. 9B, resin may flow from the terminal assembly holes 21*b* in the direction indicated by arrows 24 at the time of integral molding, and reach electrical contact portions, thereby hindering the electrical communication. Also, there is a case where components such as the connecting terminals 23 are pressed and hence deformed by being pressed by a molding pressure at the time of the integral molding (G in the figure), thereby hindering the fitting of the connector.

Therefore, as shown in FIGS. 11A to 11C, there is a case where a lid member (spacer) 27 that dogs the terminal assembly holes 21*b* is provided for preventing the resin from flowing into the terminal assembly holes 21*b* of the insulator. The lid member 27 is formed of an elastic rubber plate. The lid member 27 is assembled in a procedure shown in FIG. 11C. As shown in FIG. 12A, there is a case where a sealing material 28 is applied before molding to prevent intrusion of the resin.

However, according to a countermeasure for preventing the intrusion of the resin at the time of integral molding, for example, as shown in FIG. 11B, the shape of the connector product is upsized by an amount corresponding to an a portion in the longitudinal direction of the cable or by an amount corresponding to a 13 portion as shown in FIG. 12B. In addition, as shown in FIG. 13, water or air propagates in the leads 22 and hence enters the inside of the connector product as shown by arrows 24*a*, thereby resulting in a product inferior in air-tight properties or fluid-tight properties.

SUMMARY OF THE INVENTION

The cable connector according to the invention is proposed in order to solve the problems described above.

In order to solve the above-described problems and achieve the object, the invention provides a cable connector including a connector body formed of an insulating material and formed with a plurality of terminal through holes; connecting terminals fitted into the terminal through holes; a cable including a plurality of leads having end portions crimped to base portions of the connecting terminals respectively; and a synthetic resin bushing configured to couple the connector body, a tip end portion of the cable including the leads exposed and diverged therefrom integrally by molding; wherein stoppers are disposed between end portions of the leads and the connecting terminals and inside the connector body and prevent intrusion of synthetic resin as the bushing material so as not to flow from ends of the leads toward ends of the connecting terminals when coupling by molding.

The connector body preferably includes an outer insulating tube provided outside and an inner insulator for a terminal, contained in an inner peripheral wall surface of the outer insulating tube in sliding contact therewith, and having a plurality of terminal through holes, and the inner insulator for the terminal is formed with a communicating portion communicating with the terminal through holes in a mid section in the connecting direction, the stoppers are inserted and fitted into the communicating portion, and the stoppers are fixed so as not to be disconnected by the outer insulating tube covered on the inner insulator for the terminal.

Further, preferably, the stopper is an insulator integrally formed of synthetic resin having projecting pieces to be fitted into the respective terminal through holes and a coupling piece configured to integrally couple these projecting pieces.

According to the cable connector of the invention, with the presence of the stoppers between the connecting terminals and end portions of the leads, the stoppers are built in the product and the general size of the connector as the product may be reduced. With the provision of the stopper, the inflow of the synthetic resin toward the end side of the connecting terminal at the time of integral molding is eliminated, the conditions of the integral molding are made stable, and the productivity is achieved.

With the fixation of the connecting terminal and part (mold lance) of the inner insulator for the terminal directly with the stopper, a molding pressure applied at the time of the integral molding is reduced, and "deformation" and "slippage" of the terminal can be prevented. In addition, a fixing forte of the terminal is improved, which contributes to prevention of disconnection of the terminal.

In addition, the leads can be covered to their ends with the integral molding resin or a sealing material, to advantageously improve the airtight properties and fluid-tight properties and to advantageously block the intrusion of water or air.

DETAILED DESCRIPTION OF THE PREFERRED EMBODIMENTS

Figure 1:
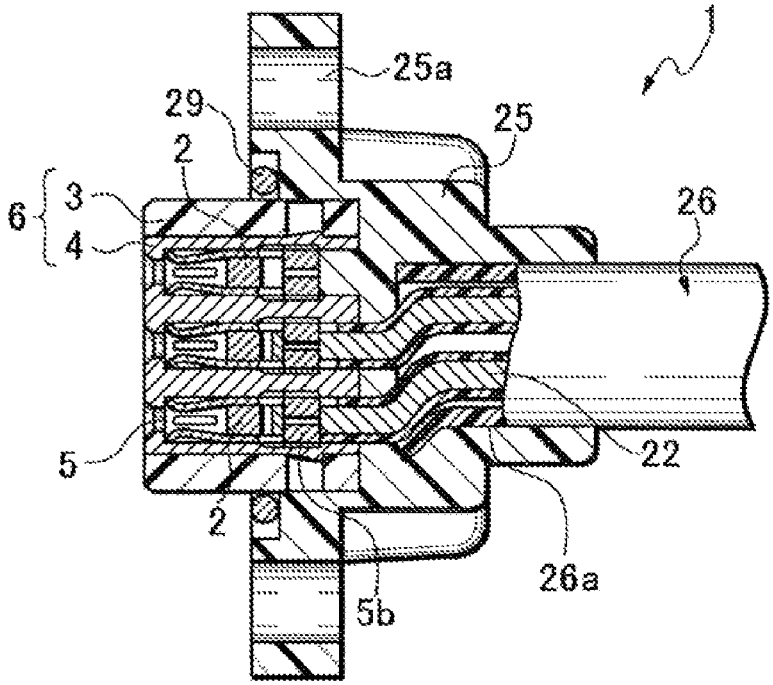
FIG. 1 is a vertical cross-sectional view showing a cable connector according to the invention.

As shown in FIG. 1, a cable connector 1 according to the invention includes a connector body 6 formed of an insulating material having a plurality of terminal through holes 4*a* formed therethrough, connecting terminals 5 fitted into the terminal through holes 4*a*, cable 26 including a plurality of leads having end portions that are crimped to base portions (clamping portions) 5*b* of the connecting terminals 5, a bushing 25 formed of synthetic resin for coupling the connector body 6 and a tip end portion of the cable 26 including leads 22 exposed and diverged therefrom integrally by molding, and stoppers 2 configured to prevent the synthetic resin from flowing into the connector body 6 for preventing the synthetic resin as the bushing material from flowing from ends of the leads into end sides of the connecting terminals when coupling by molding.

The connector body 6 includes an outer insulating tube 3 shown in FIGS. 3A to 3F, and an inner insulator 4 for a terminal being contained in an inner peripheral wall surface of the outer insulating tube 3 shown in FIGS. 4A to 4F in sliding contact therewith and having the plurality of terminal through holes 4*a* formed therein. The inner insulator 4 for the terminal is formed with communicating portions 4*b* communicating with the terminal through holes 4*a* at a mid section in the connecting (fore-and-aft) direction.

As shown in FIGS. 5A to 5F, each of the connecting terminals 5 is formed at the end side thereof with electrical connecting portions 5*a* which are electrically connected to a contact of a connecting partner, and at the rear end side with an intermediary of coupling portion 5*c* with a base portion (clamping portion) 5*b* where the end portion of the lead 22 is clamped and secured.

The stoppers 2 are inserted from the communicating portions 4*b* of the inner insulator 4 for the terminal to be disposed between the end portions of the leads 22 and the electrical connecting portions 5*a* of the connecting terminals 5 and also inside the outer insulating tube 3, and prevents the intrusion of the synthetic resin, which is the material of the bushing 25, from flowing from the ends of the leads 22 toward the end sides of the connecting terminals 5 when coupling by molding.

Figure 6:
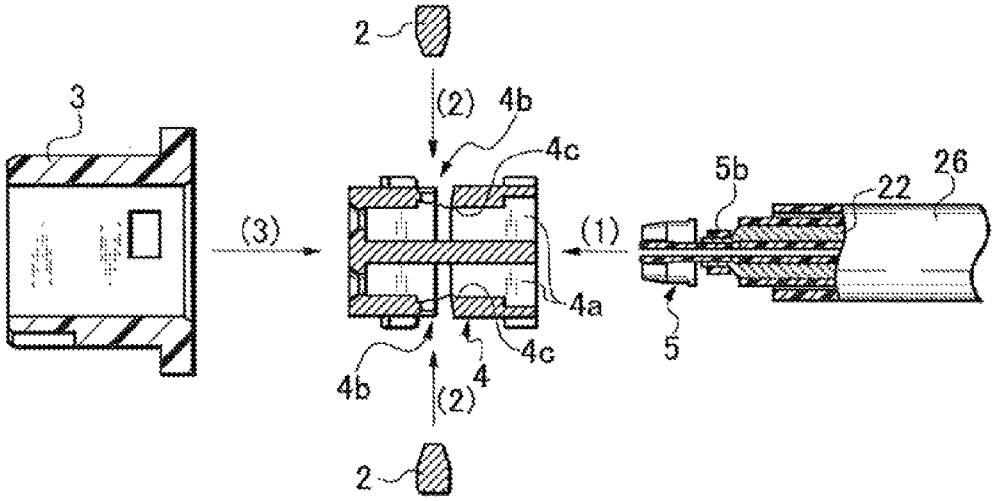
FIG. 6 is an exploded cross-sectional view showing an assembly procedure of the cable connector.
Figure 7:
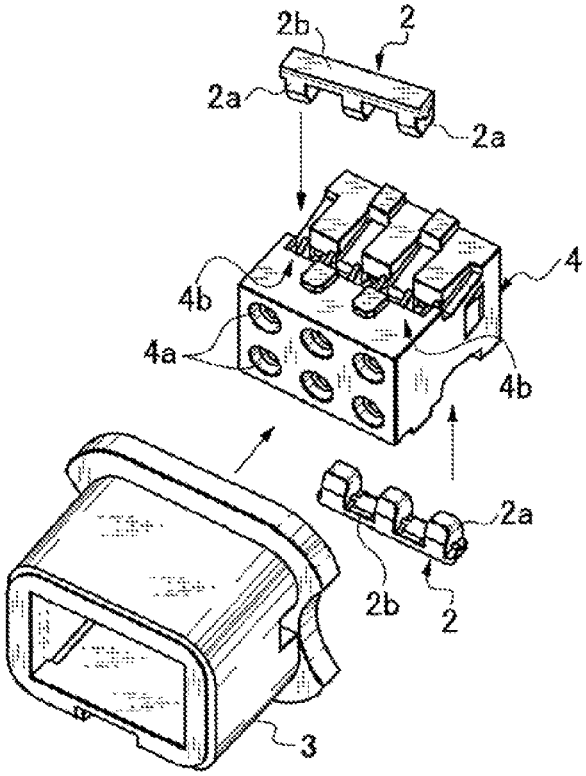
FIG. 7 is an exploded perspective view showing an assembly procedure of the cable connector.

The stopper 2, as shown in FIGS. 1, 6, and 7, is an insulator integrally formed of synthetic resin having a connecting piece 2*b* connecting projecting pieces 2*a* disposed corresponding to the respective connecting terminals 5 so as to prevent the inflow of the synthetic resin in a molten state when coupling the connector body 6 and tip end of cable 26 including exposed and diverged leads 22 integrally by molding. In this manner, by forming the stoppers 2 integrally, the lateral slippage of the projecting pieces 2*a* fitted into the respective communicating portions 4*b* is prevented.

Figure 5A:
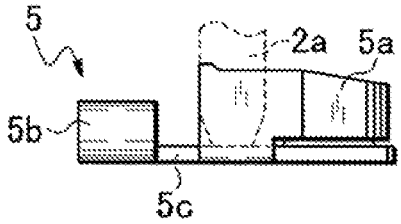
FIGS. 5A to 5F are a front view, a bottom view, a back view, a plan view, and left and right side views respectively showing connecting terminals in the cable connector.
Figure 5B:
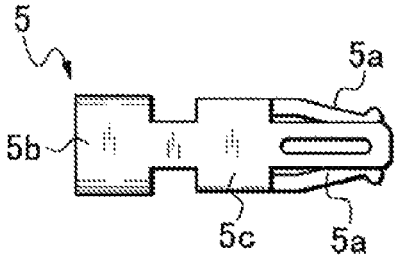
Figure 5C:
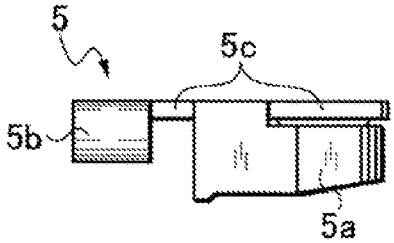
Figure 5E:
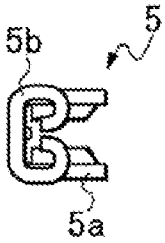
Figure 5D:
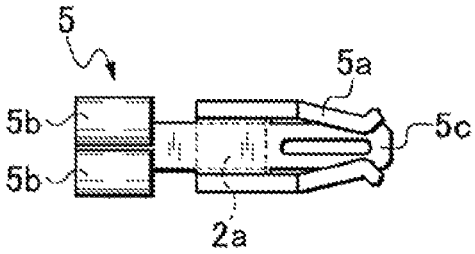
Figure 5F:
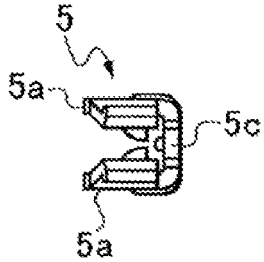
Figure 8:
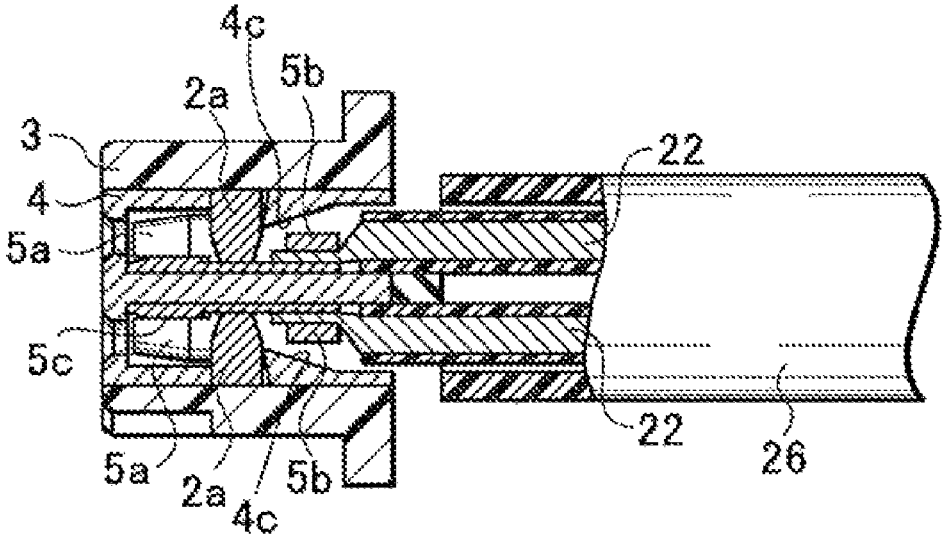
FIG. 8 is an enlarged lateral cross-sectional view showing a state before integral molding of the cable connector.
Figure 9A:
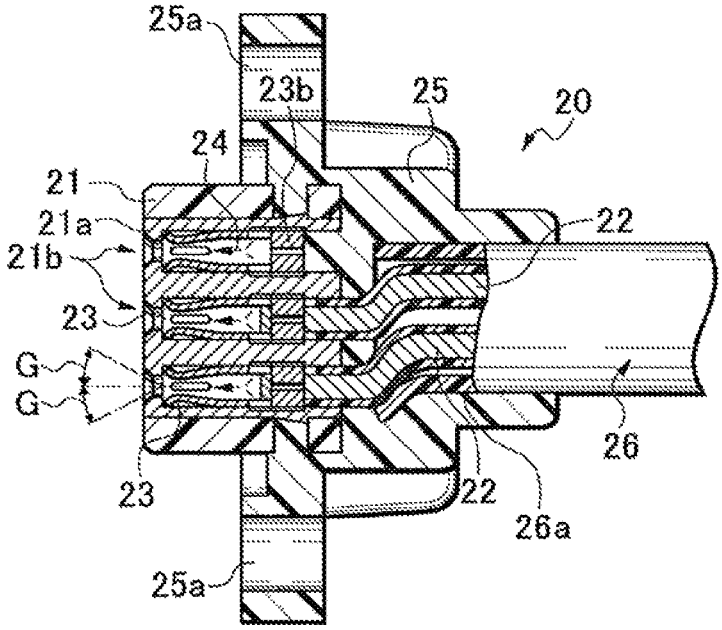
Fig. 9A PRIOR ART
FIGS. 9A and 9B are a vertical cross-sectional view and a lateral cross-sectional view respectively showing a connector according to the prior art.
Figure 9B:
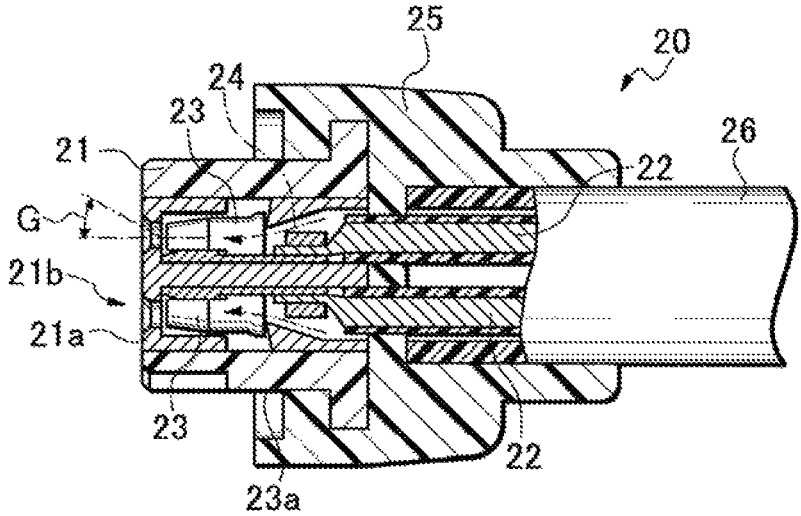
Fig. 9B PRIOR ART
Figure 10A:
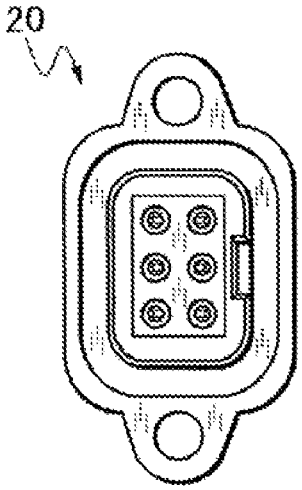
Fig. 10A PRIOR ART
FIGS. 10A to 10C are a front view, a side view, and a bottom view of the connector, respectively.
Figure 10B:
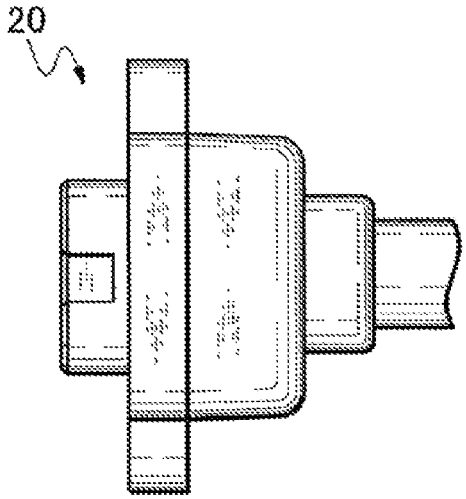
Fig. 10B PRIOR ART
Figure 10C:
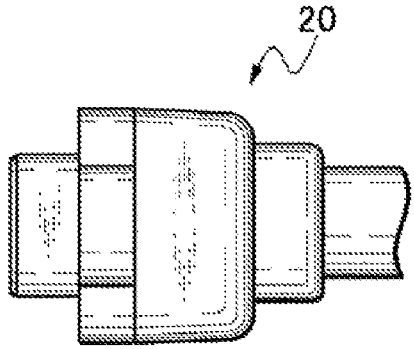
Fig. 10C PRIOR ART
Figures 11A, 11B, 11C:
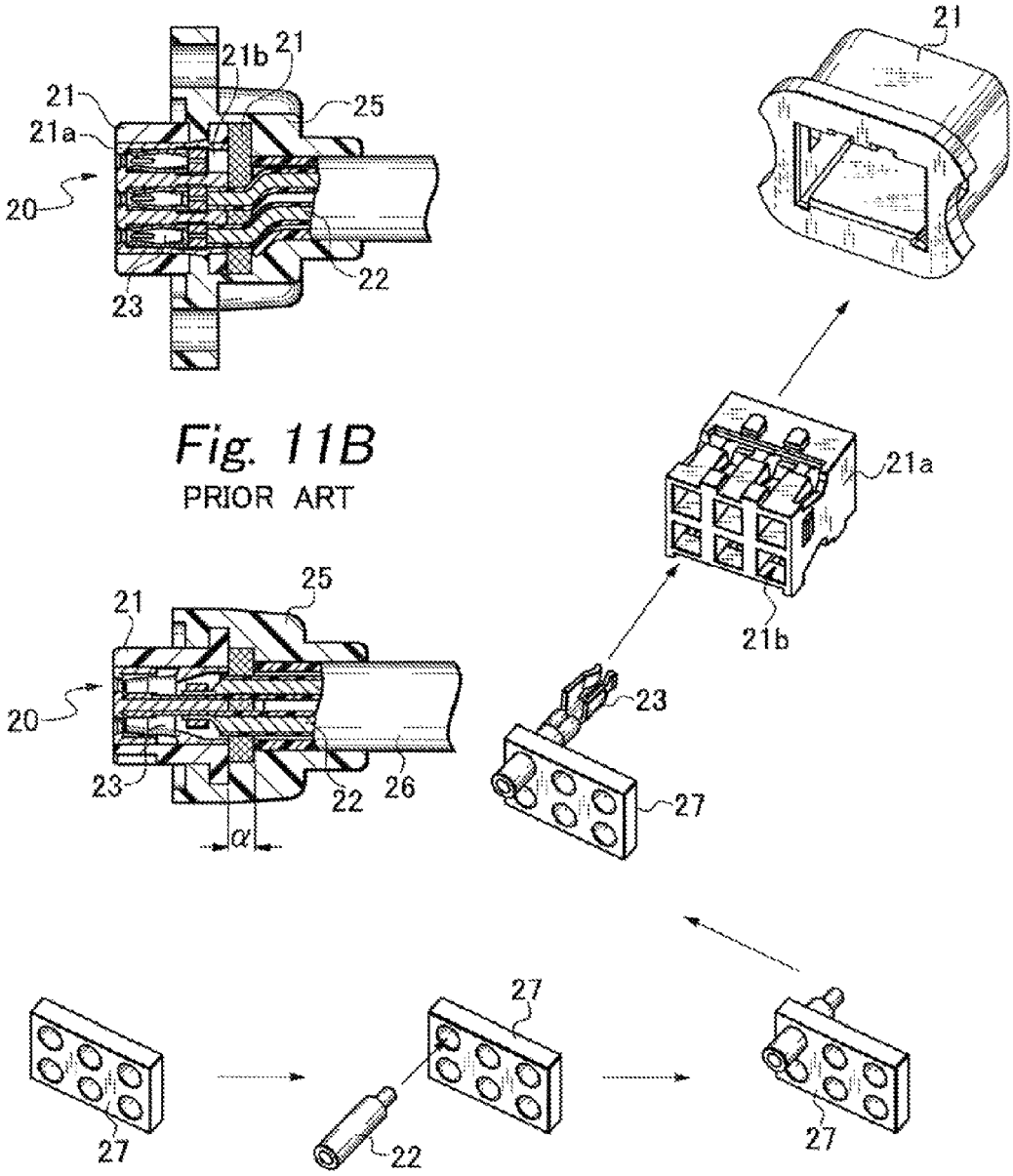
Fig. 11A PRIOR ART
Fig. 11B PRIOR ART
Fig. 11C PRIOR ART
FIGS. 11A to 11C are a vertical cross-sectional view, a lateral cross-sectional view, and an exploded perspective view respectively showing an assembly procedure of the connector, illustrating an example in which a lid member for preventing the inflow of the synthetic resin is provided.
Figure 12A:
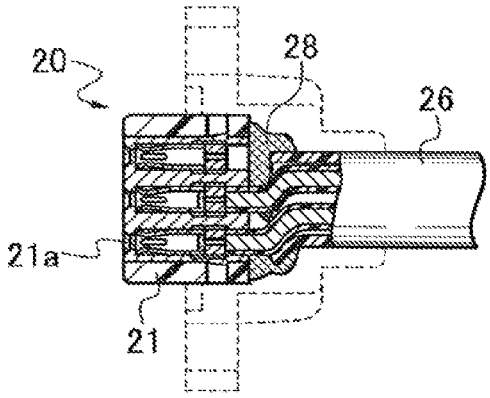
Fig. 12A PRIOR ART
FIGS. 12A and 12B are a vertical cross-sectional view and a lateral cross-sectional view illustrating an example of the connector in which a sealing material that prevents the inflow of the synthetic resin is provided.
Figure 12B:
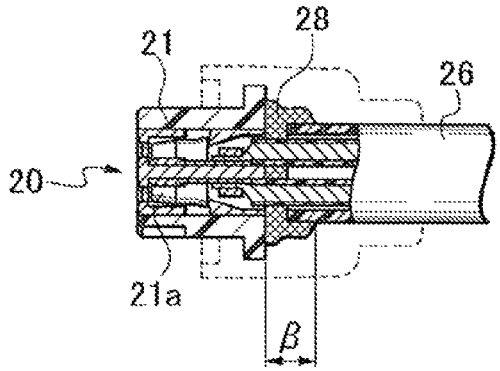
Fig. 12B PRIOR ART
Figure 13:
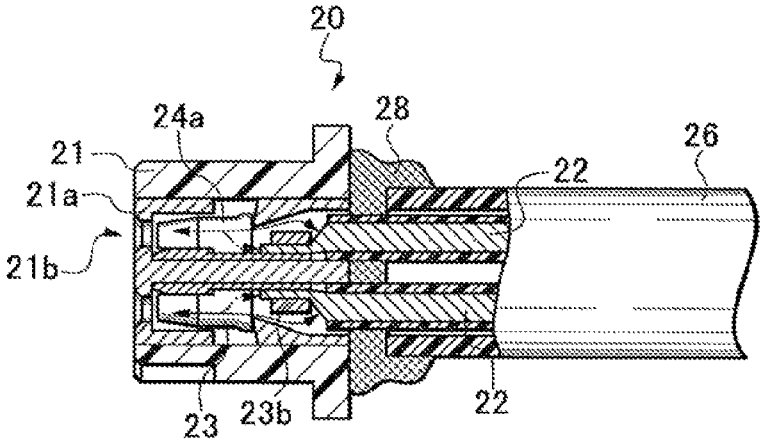
Fig. 13 PRIOR ART
FIG. 13 is a lateral cross-sectional view showing an example in which the sealing material that prevents the inflow of the synthetic resin in the connector is provided.

The stoppers 2 are inserted and fitted into the communicating portions 4*b* of the inner insulator 4 for the terminal before coupling the connector body 6 and tip end of cable 26 including exposed and diverged leads 22 integrally by molding with the synthetic resin as the material of the bushing 25, so that a state shown in FIG. 8 is assumed. In other words, the stoppers 2 are arranged between the electrical connecting portions 5*a* of the connecting terminals 5 and mold lance portions 4*c* of the inner insulator 4 for the terminal. As a result of fitting of the stoppers 2 into the communicating portions 4*b*, the projecting pieces 2*a* enter between the electrical connecting portions 5*a* and 5*a* of the connecting terminals 5 as shown in FIGS. 5A and 5D.

In order to assemble the cable connector 1 as described above, the leads 22 having the connecting terminals 5 secured to the respective ends thereof are firstly fitted into the inner insulator 4 for the terminal as shown in FIG. 6 and FIG. 7. Subsequently, the connecting terminals 5 are fitted into the terminal through holes 4*a* from the rear toward the front respectively, and are press-fitted and secured thereto (see an arrow (1) in FIG. 6).

Then, the stoppers 2 are fitted into the communicating portions 4*b* of the inner insulator 4 for the terminal in the upward and downward directions (see an arrow (2) in FIG. 6). Subsequently, the outer insulating tube 3 is covered on the inner insulator 4 for the terminal (see an arrow (3) in FIG. 6 and FIG. 7). As the result, the stoppers 2 are fixed so as to be prevented from coming apart in the upward and downward directions.

Figure 2:
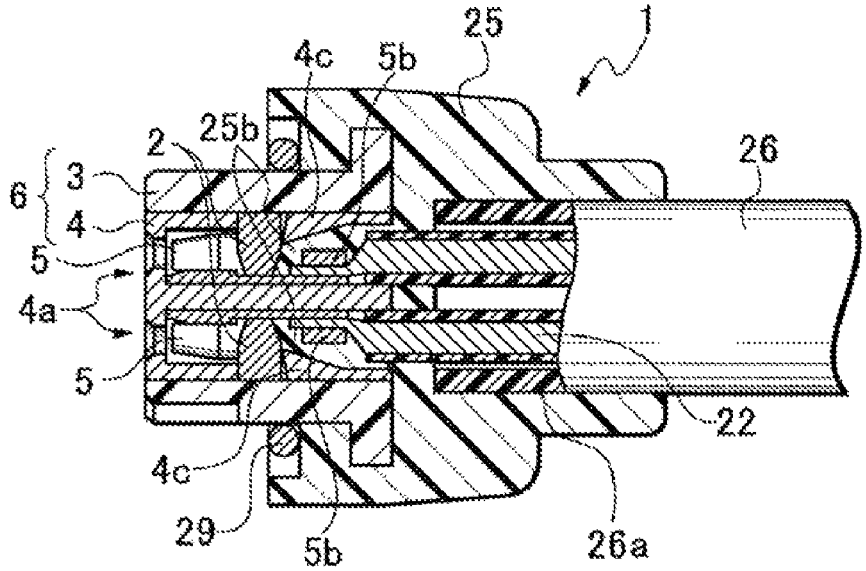
FIG. 2 is a lateral cross-sectional view showing the cable connector.
Figure 3B:
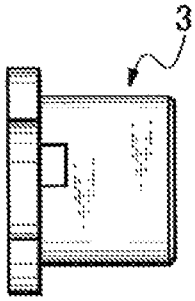
FIGS. 3A to 3F are a front view, left and right side views, a plan view, a bottom view, and a back view respectively showing an outer insulating tube in the cable connector.
Figure 3A:
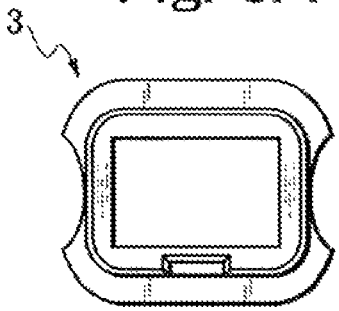
Figure 3C:
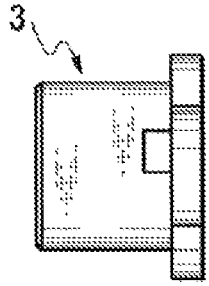
Figure 3D:
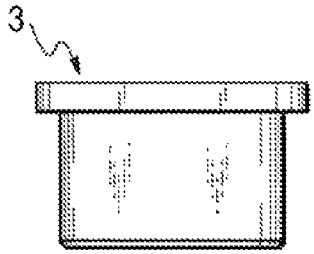
Figure 3E:
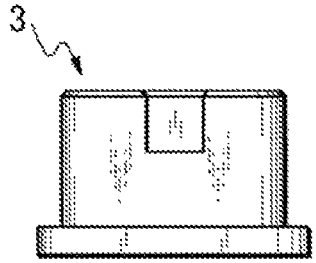
Figure 3F:
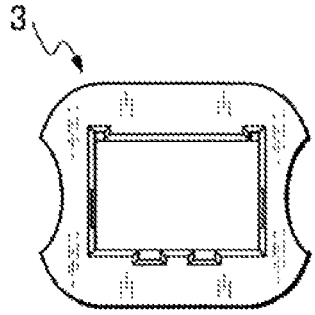
Figure 4D:
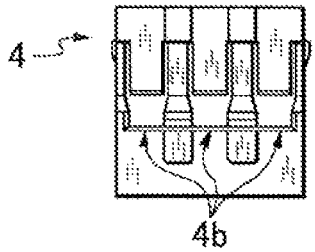
FIGS. 4A to 4F are a front view, left and right side views, a plan view, a bottom view, and a back view respectively showing an inner insulator for a terminal in the cable connector.
Figure 4B:
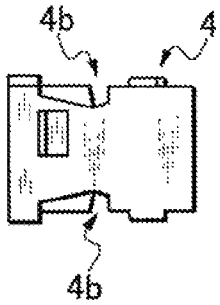
Figure 4A:
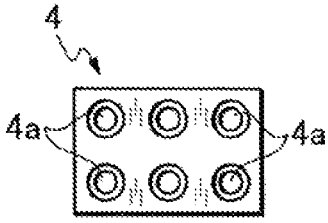
Figure 4C:
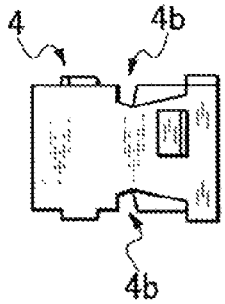
Figure 4E:
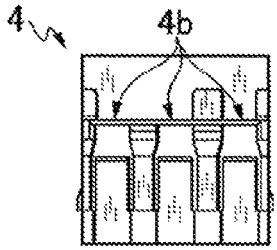
Figure 4F:
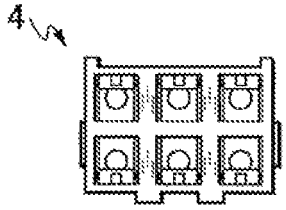

FIGS. 6 and 7 show the cable connector 1 before being coupled integrally by molding. The cable connector 1 according to the invention as shown in FIGS. 1 and 2 is formed by setting the state of the assembly shown in FIG. 8 as described above into a metal mold and coupling the same integrally by molding. As shown in FIG. 2, even when the synthetic resin in the molten state intrudes through a gap between a rear inner edge portion of the inner insulator 4 for the terminal of the connector body 6 and outer peripheral surfaces of the leads 22, an intruded synthetic resin 25*b* is prevented from flowing forward of the connecting terminals 5 by the stoppers 2.

Water or air is also prevented from intruding from the front of the through holes 4*a* and propagating in the cables 22 by the stoppers 2 secured to the connecting terminals 5 in an air-tight manner. Furthermore, by being pressed by the stoppers 2 directly, the connecting terminals 5 are prevented from lifting and hence deformation or slippage due to the pressure of molding is prevented. Accordingly, the connecting terminals 5 are fixed firmly to the inner insulator 4 for the terminal and the resistance with respect to a pulling operation of the cable is increased.

The cable connector according to the invention is widely applicable not only as a cable connector, but also as a normal electrical connector.

What is claimed is:

1. A cable connector comprising:

a connector body formed of an insulating material and having a plurality of terminal through holes extending in a longitudinal direction;

connecting terminals fitted longitudinally in said terminal through holes;

a longitudinally-extending cable including a plurality of leads having end portions that are respectively crimped to base portions of the connecting terminals; and a synthetic resin bushing configured to integrally couple said connector body and a tip end portion of said cable;

wherein said connector body includes an outer insulating tube, and an inner insulator disposed inside said outer insulating tube and about said connecting terminals to insulate said connecting terminals, said inner insulator being in sliding contact with an inner peripheral wall surface of said outer insulating tube;

wherein said inner insulator includes communicating portions constituting laterally-extending holes formed in a longitudinal mid-section of said inner insulator and communicating with said communicating terminals;

wherein stoppers are respectively fitted laterally through said communicating portions so as to be disposed longitudinally between said connecting terminals and said end portions of said leads to prevent synthetic resin bushing material from intrusively flowing from said end portions of the leads toward ends of the connecting terminals during coupling by molding of said synthetic resin bushing; and wherein said outer insulating tube covers said communicating portions of said inner insulator from outside to laterally position said stoppers and prevent disconnection of said stoppers.

2. The cable connector according to claim 1, wherein said stoppers are constituted by molded insulating synthetic resin members; and each of said stoppers includes projecting pieces respectively fitted into said terminal through holes and a coupling piece integrally coupling said projecting pieces.

3. The cable connector according to claim 2, wherein for each of said stoppers, said projecting pieces project from said coupling piece in a lateral direction.

* * * * *